US005765921A

United States Patent [19]

Chuang

[11] Patent Number: 5,765,921

[45] Date of Patent: Jun. 16, 1998

[54] PEDAL STRUCTURE

[76] Inventor: Min Lon Chuang, 9th Fl., No. 155, Sec. 1, Keelung Rd.., Taipei, Taiwan

[21] Appl. No.: 790,488

[22] Filed: Jan. 29, 1997

[51] Int. Cl.[6] ..... A47C 16/00

[52] U.S. Cl. ..... 297/423.46; 297/423.45; 297/423.41; 601/32; 601/28; 601/118; 482/80

[58] Field of Search ..... 297/423.26, 423.27, 297/423.39, 423.41, 423.44, 423.45, 423.46; 601/28, 31, 32, 118, 131, 134; 482/79, 80

[56] References Cited

U.S. PATENT DOCUMENTS

| | | | |
|---|---|---|---|
| 2,752,915 | 7/1956 | Riblet | 601/118 |
| 3,035,570 | 5/1962 | Nelson | 601/31 |
| 4,991,908 | 2/1991 | Krechel | 297/423.41 |
| 5,024,485 | 6/1991 | Berg et al. | 297/312 |
| 5,643,164 | 7/1997 | Teff | 601/28 |

*Primary Examiner*—Peter M. Cuomo
*Assistant Examiner*—Anthony D. Barfield
*Attorney, Agent, or Firm*—Beveridge, Degrandi, Weilacher & Young, LLP

[57] ABSTRACT

A pedal structure mainly including a pair of bases each having a facing-inward long recess with toothed side walls, a pair of adjusting supports each including an upper shaft holder portion for receiving one end of a shaft and a lower coupling rod portion having toothed side walls for engaging with the long recess of the base, and a pair of pedals pivotally rotatably assembled to the shaft extending between the two shaft holder portions of the adjusting supports. The pedal structure is characterized in that a massage ball is rotatably mounted at a central point of the shaft, that the adjusting supports may be adjusted in height by engaging their toothed side walls with the toothed side walls of the long recesses at different levels so that the pedal structure can be comfortably used by different users even they have different leg lengths or sit in chair of different heights, that the two pedals can be either locked together to move synchronously or not locked to move independently, and that the two pedals can be locked in any suitably inclined position without being rotated about the shaft.

9 Claims, 12 Drawing Sheets

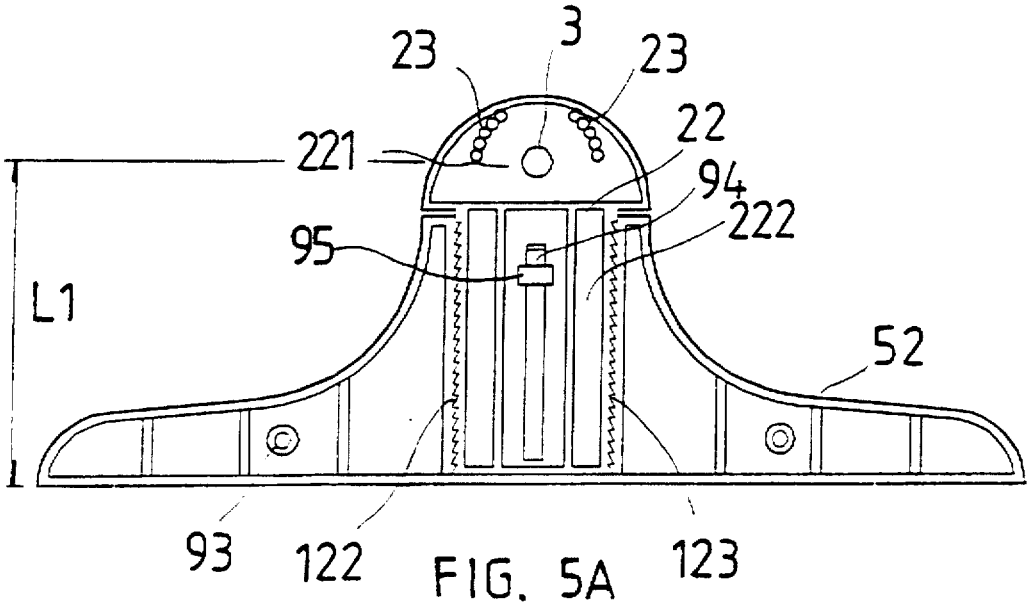
FIG. 5A
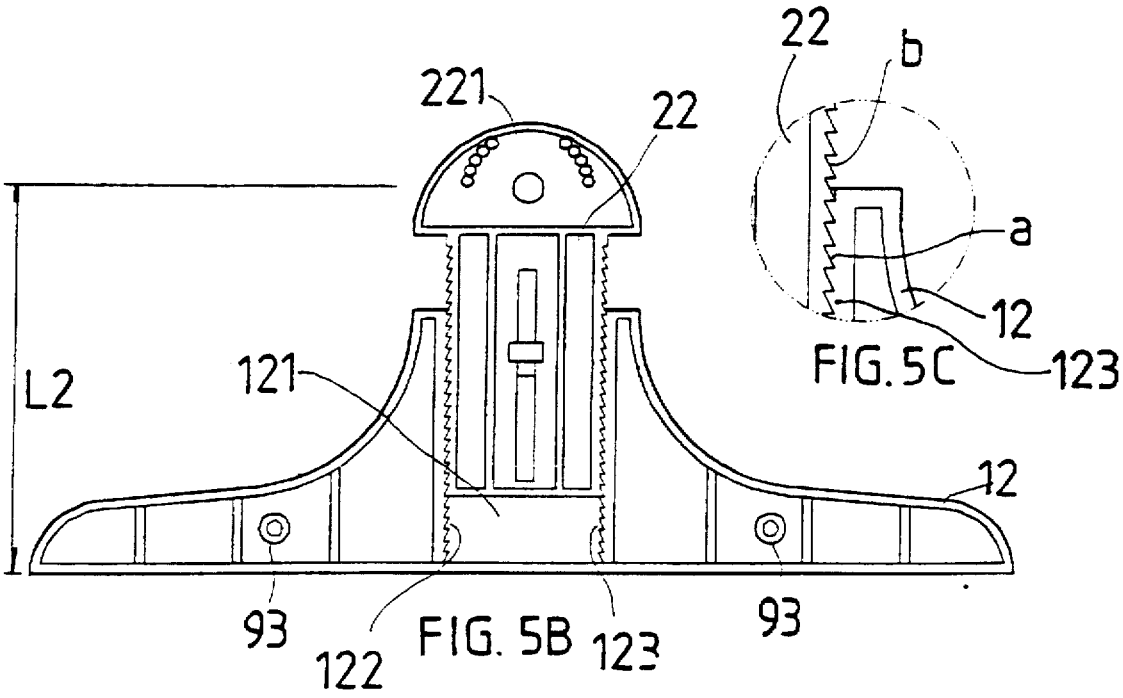
FIG. 5C
FIG. 5B

PEDAL STRUCTURE

BACKGROUND OF THE INVENTION

1. Field of the Invention

The present invention relates to a pedal structure, and more particularly to a pedal structure including a pair of pedals which can be adjusted in height, be pivotally turned in the same or different directions, and be provided with massage means. The pedal structure of the present invention can be used in office or home to permit a user to work, read, and the like in a more comfortable state.

2. Description of the Prior Art

A desk in the early stage usually had a bar horizontally extending across a lower part of the desk. A user may rest his or her foot or feet on the horizontal bar. Such horizontal bar was fixedly connected at two ends to bottom edges of drawers or side walls of the desk. For users of different heights, such a fixedly mounted horizontal bar under a desk for resting feet was not practical in use, and even causes discomfort to the users.

Therefore, it is desirable to develop a multipurpose and adjustable pedal structure to replace the conventional fixed horizontal bar under the desk so as to create a more comfortable working and living environment.

SUMMARY OF THE INVENTION

A primary object of the present invention is to provide a pedal structure having a pair of height-adjustable pedals, so that the pedal structure is suitable for users of different heights and foot lengths. Moreover, the pair of pedals can be fixedly locked or pivotally turnable, depending on the need of users.

Another object of the present invention is to provide a pedal structure having a pair of pedals, wherein the pedals can be pivotally turned in the same or different directions.

A further object of the present invention is to provide a pedal structure having a pair of pedals, wherein a rotatable massage ball is mounted between the two pedals, forming a sole massage means.

A still further object of the present invention is to provide a pedal structure having a pair of pedals, wherein the two pedals can be locked to different angular positions to meet the user's different requirements and to allow the feet to be more comfortably rested on the pedals.

BRIEF DESCRIPTION OF THE DRAWINGS

The structural features and the operation of the present invention can be best understood by referring to the following detailed description of the preferred embodiments and the accompanying drawings, wherein FIG. 1 an exploded perspective of the present invention;

FIGS. 5A and 5B are sectional views taken on line 5—5 of FIG. 4A, showing the manner in which the adjusting support is received in the base of the present invention in different heights;

FIG. 5C is an enlarged, fragmentary, sectional view showing the engagement of teeth provided on the surfaces of the adjusting support and the base of the present invention;

DETAILED DESCRIPTION OF THE PREFERRED EMBODIMENTS

Figure 1:
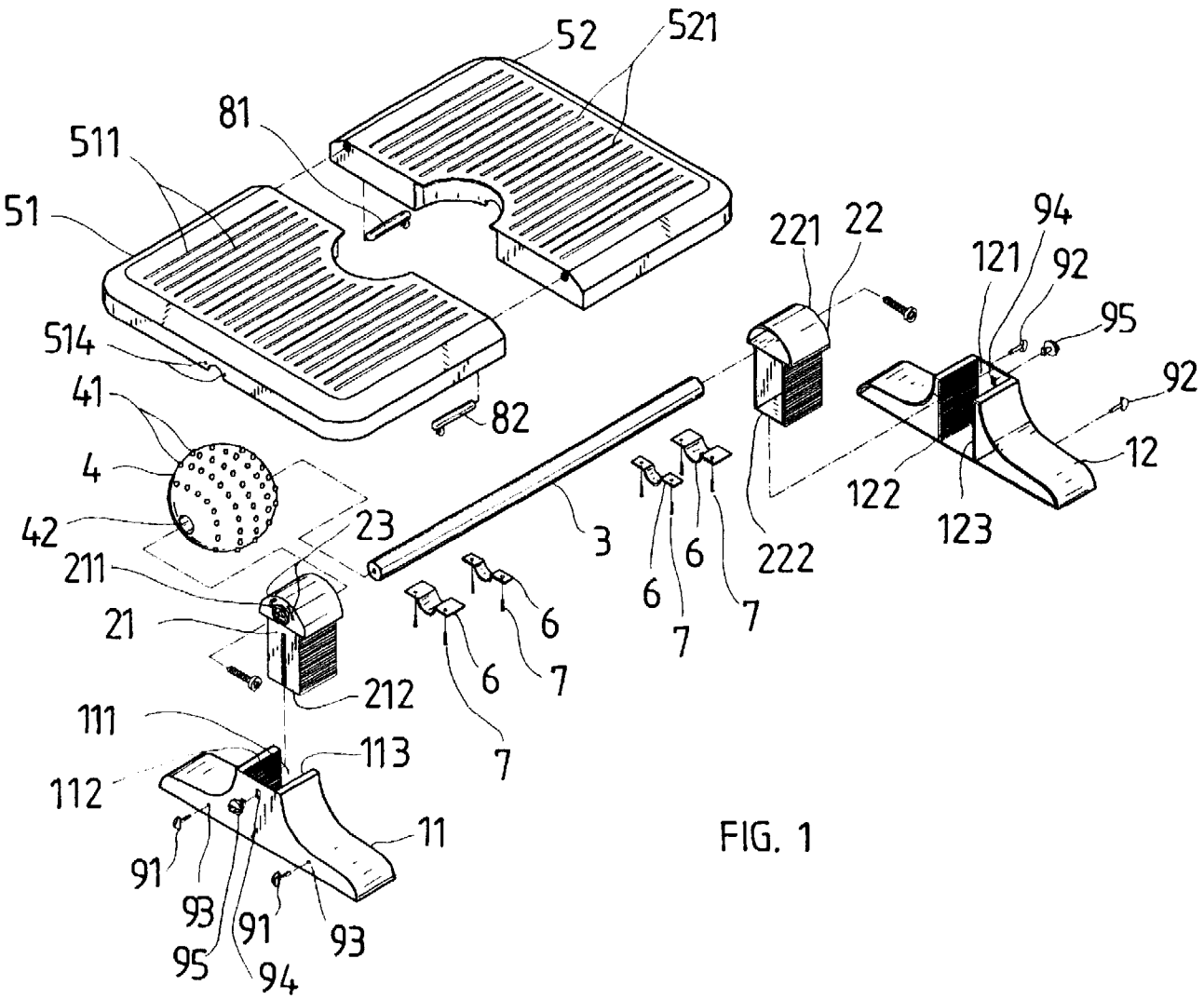
Figure 2:
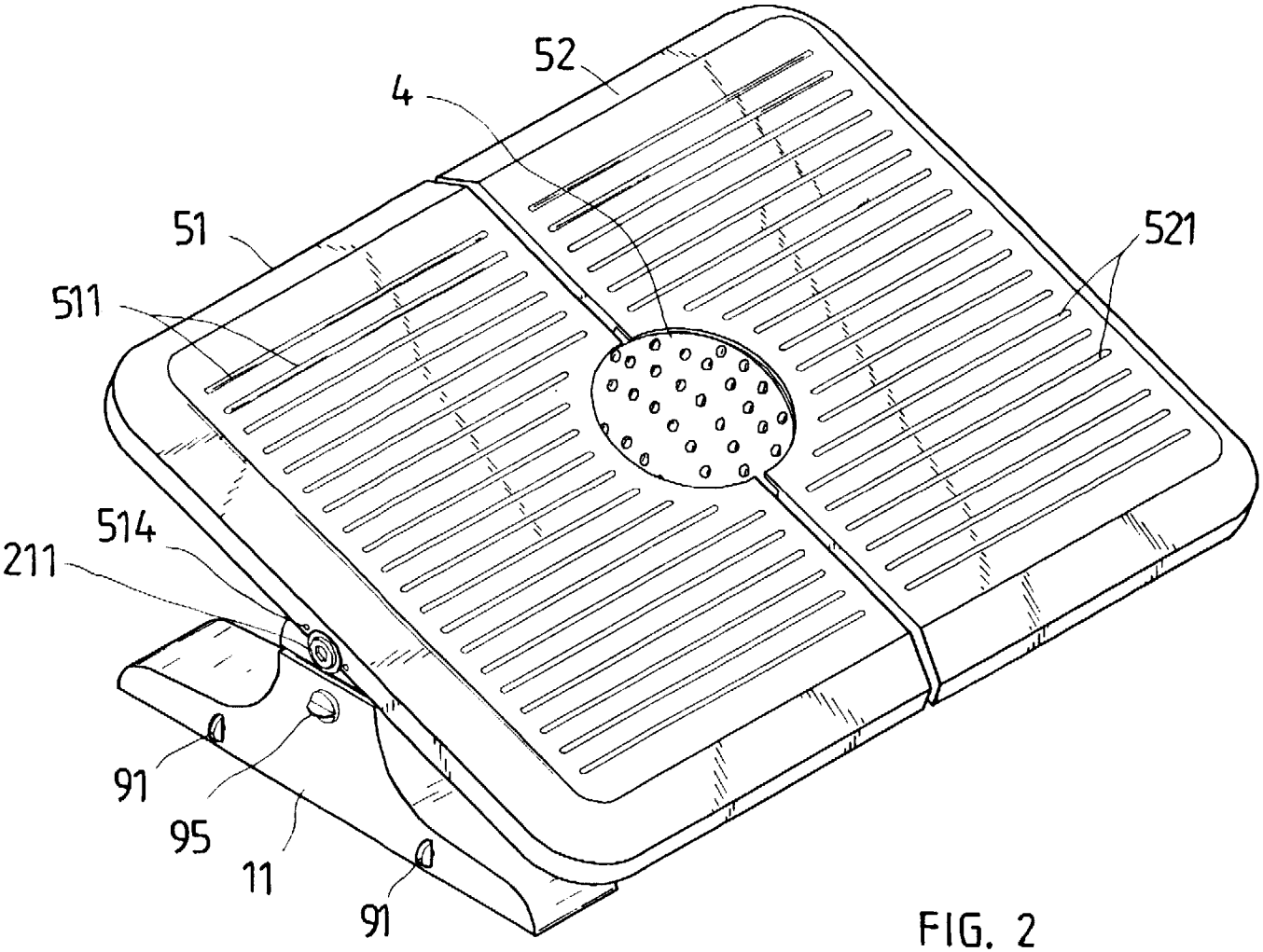
FIG. 2 is a perspective showing the present invention in an assembled state.
Figure 3:
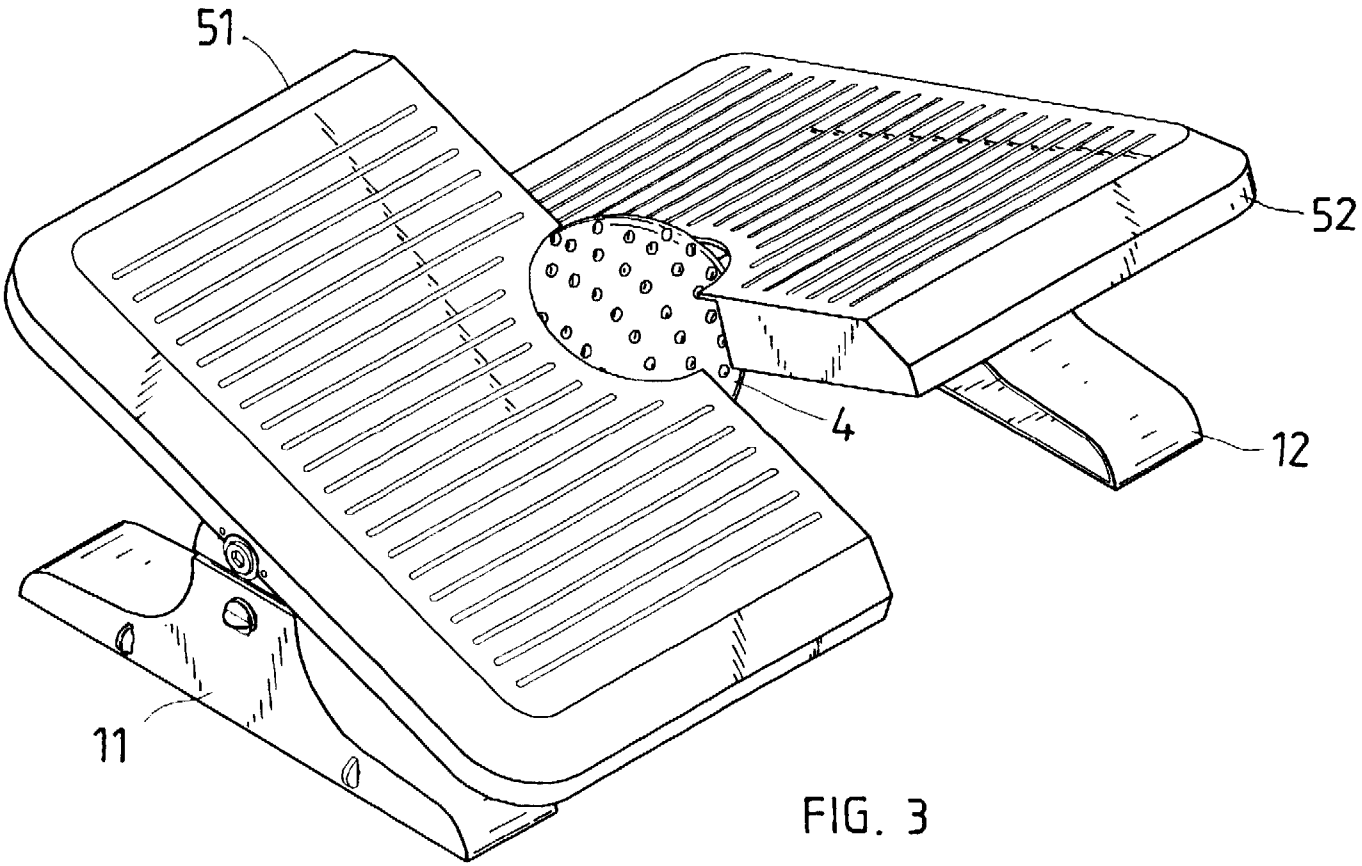
FIG. 3 is another perspective showing the two pedals of the present invention are pivotally turned independently.

Please refer to FIGS. 1 and 2. The present invention relates to a pedal structure which mainly includes a pair of bases 11 and 12, a pair of adjusting supports 21 and 22, a shaft 3, a massage ball 4 rotatably mounted on the shaft 3, and a pair of pedals 51 and 52.

The two bases 11 and 12 are formed at an inner side with a vertically extended long recess 111, 121, respectively. The long recesses 111 and 121 have two inner side walls 112, 113 and 122, 123, respectively, provided with horizontally and parallelly extended teeth a.

The two adjusting supports 21, 22 both include an upper shaft holder portion 211 or 221 for each receiving one end of the shaft 3 and a lower coupling rod portion 212 or 222 fitly received in the long recess 111 or 121 of the two bases 11 and 12. The coupling rod portion 212 or 222 has two outer side walls 213 or 223 provided with horizontally and parallelly extended teeth b to fitly engage with the teeth a on the two inner side walls of the long recess 111 or 121, as shown in FIGS. 5A, 5B and 5C. By engaging teeth b with teeth a at different heights, the coupling rod portions 212 and 222 can project from the long recesses 111 and 121, respectively, by different lengths. Thereby, the shaft 3 supported by the upper shaft holder portions 211 and 221 of the adjusting supports 21 and 22 can be adjusted in its level and height. FIG. 5A illustrates the lower coupling portion 222 deeply extending into the long recess 121, and FIG. 5B illustrates the lower coupling portion 222 not so deeply extending into the long recess 121, leaving a height L1 of the shaft 3 in FIG. 5A less than a height L2 of the shaft 3 in FIG. 5B.

Figure 6:
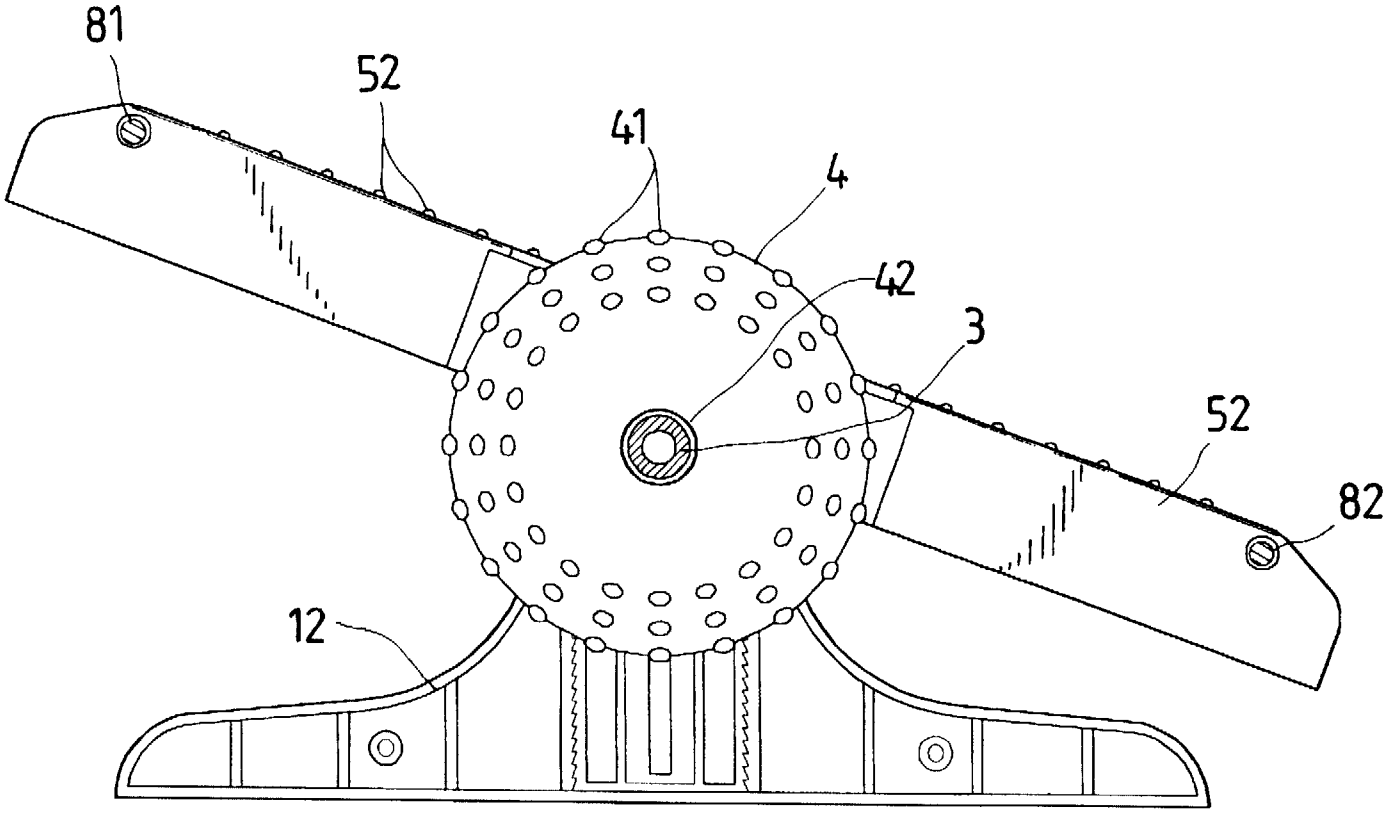
FIG. 6 is a sectional view taken on line 6—6 of FIG. 4A.

The massage ball 4 has a centered through hole 42 which allows the shaft 3 to extend therethrough, so that the massage ball 4 can freely rotate about the shaft 3, as shown in FIG. 6. The massage ball 4 has a plurality of protuberances 41 spread over an outer surface thereof A user may force the massage ball 4 to rotate by resting his or her foot or feet on the massage ball 4 and thereby gets his or her sole or soles massaged by the protuberances 41.

The shaft 3 is attached to bottom surfaces of the two pedals 51 and 52 by braces 6 wrapping the shaft 3 and secured to the pedals 51 and 52 by means of screws 7. As shown in FIG. 1, at least two braces 6 are used to assemble the shaft 3 to one pedal 51 or 52, so that each pedal 51 or 52 can be smoothly and stably rotated about the shaft 3. A plurality of transverse fine lines 511 and 521 may be provided on top surfaces of the pedals 51 and 52 to provide stronger resistance, lest the user's feet should skid from the pedals 51 and 52 when they contact with the pedals 51 and 52. By this way, the pedals 51 and 52 can be more easily swung about the shaft 3 with two feet in a controlled manner.

Figure 4A:
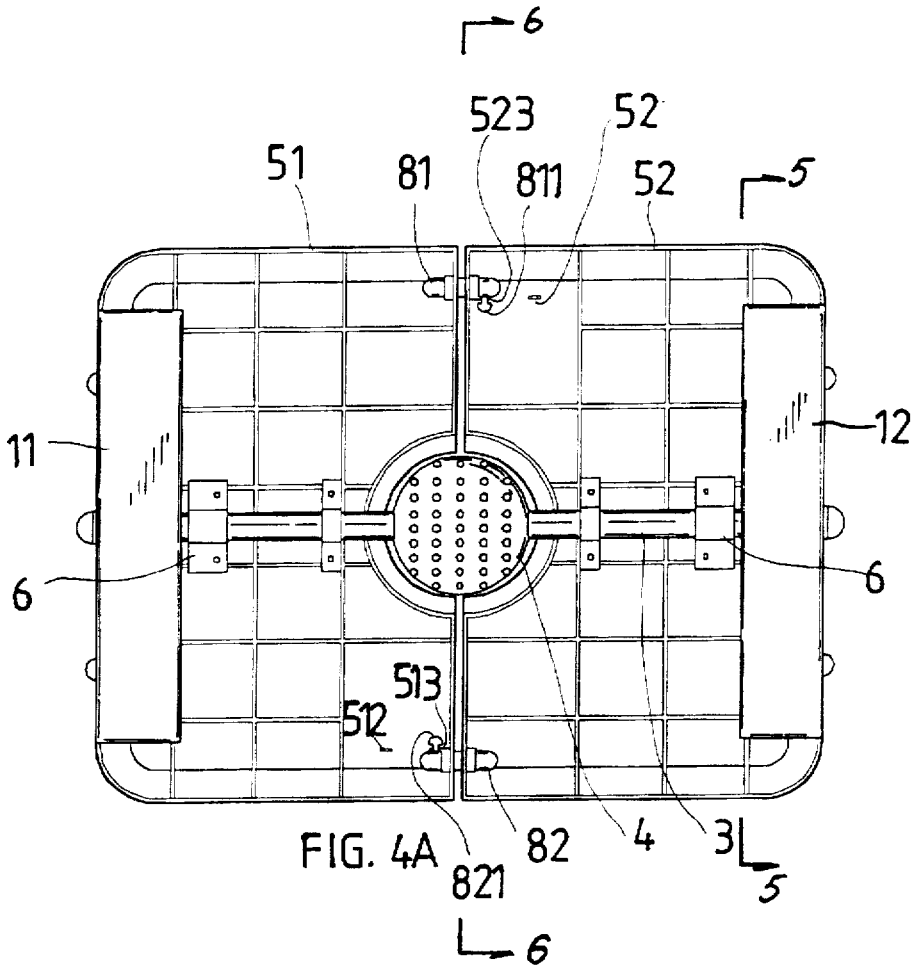
FIGS. 4A and 4B are bottom views of the present invention, showing the two pedal a latch-locked and a latch-released condition, respectively.
Figure 4B:
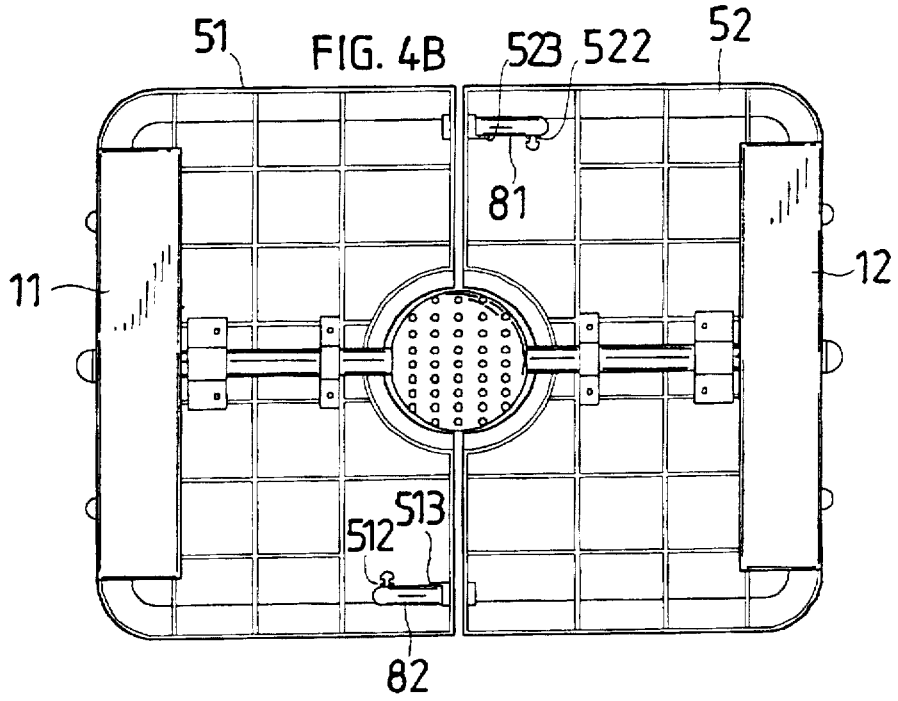
Figure 7:
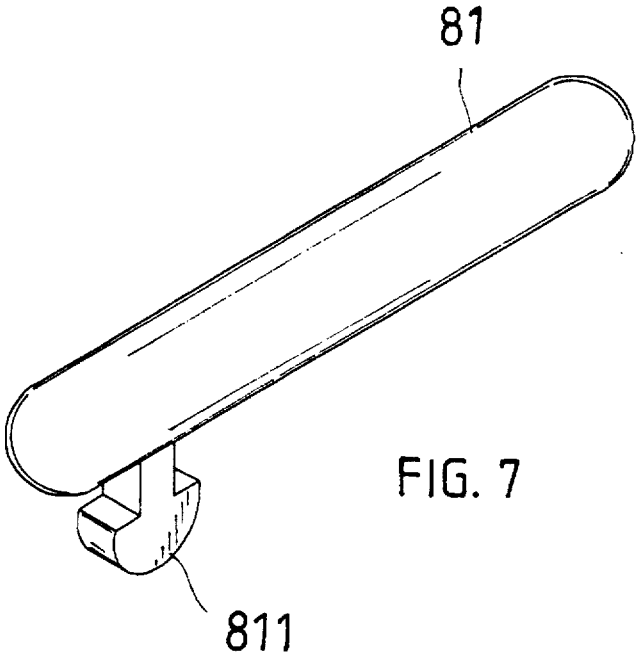
FIG. 7 is an enlarged perspective of the pedal latch for locking two pedals together.
Figure 8:
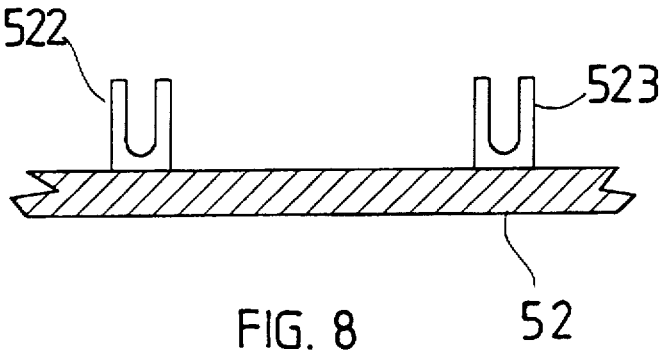
FIG. 8 is a fragmentary plan view showing the catchers provided on bottom surfaces of the pedals for receiving the pedal latches of the present invention.

Please refer to FIGS. 4A and 4B, a pair of pedal latches 81 and 82 are provided to bottom surfaces of the pedals 52 and 51, respectively, near their adjacent side walls and separately located at two sides of the shaft 3. As shown in FIG. 7, the pedal latches 81 and 82 both include a tail retaining block 811 or 821. In addition, catcher pairs 512, 513 and 522, 523 are provided to the bottom surfaces of the pedals 51 and 52, respectively, to correspond to the pedal latches 82 and 81, respectively. FIG. 8 illustrates the catcher pair 522, 523 on the pedal 52. Since the catcher pair 512, 513 are identical to the catcher pair 522, 523, they are not repeatedly described. As shown in FIG. 4A, when the pedal latches 81 and 82 extend through two adjacent side walls of the pedals 51 and 52, the two pedals 51 and 52 are locked together to move at the same time. And, as shown in FIG. 4B, when the pedal latches 81 and 82 are backed to be within the pedals 52 and 51, respectively, the two pedals 51 and 52 can be swung independently.

Figure 9:
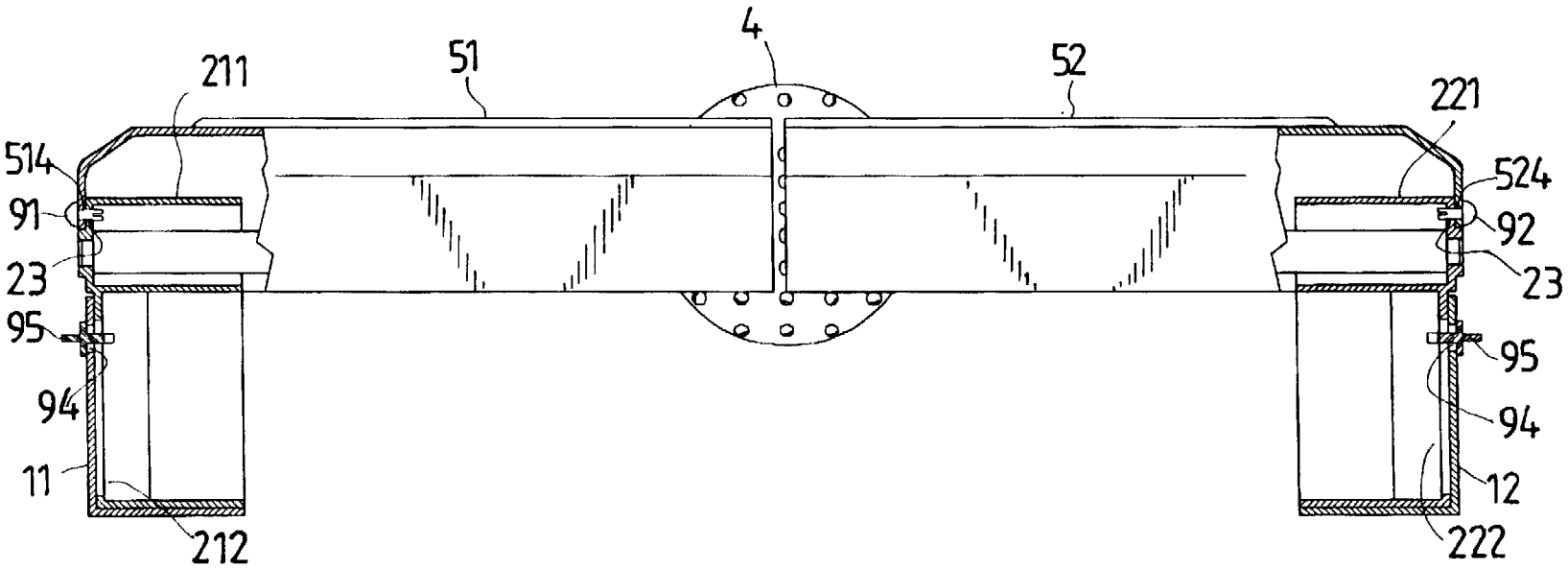
FIG. 9 is a front view of the present invention with a part thereof taken away to show the manner in which locking pins are extended through locking holes and locating holes to lock the pedals in a fixed position.
Figure 10A:
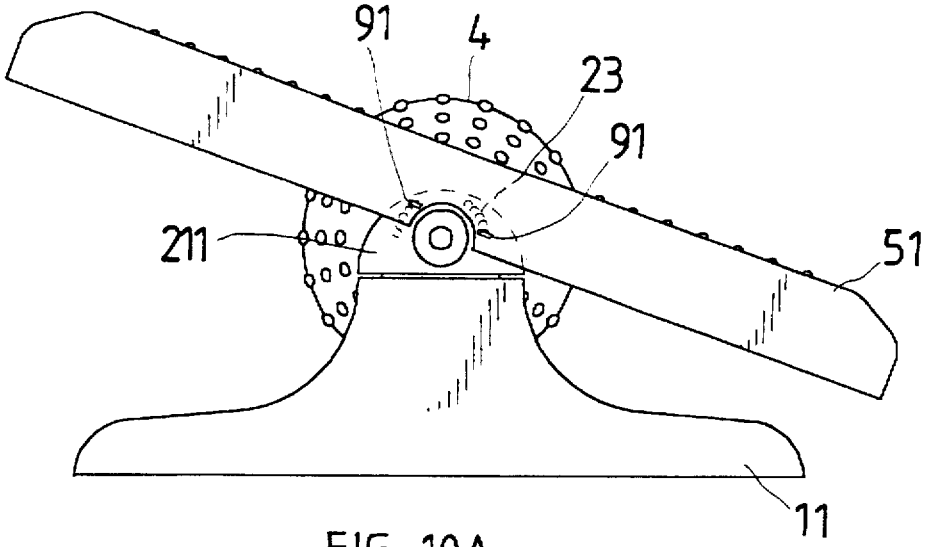
FIGS. 10A and 10B are side views of the present invention showing the pedal being locked at an inclined position by the locking pins inserted into the locking holes and the locating holes, wherein the pedal in FIG. 10A has an inclination larger than that of the pedal in FIG. 10B.
Figure 10B:
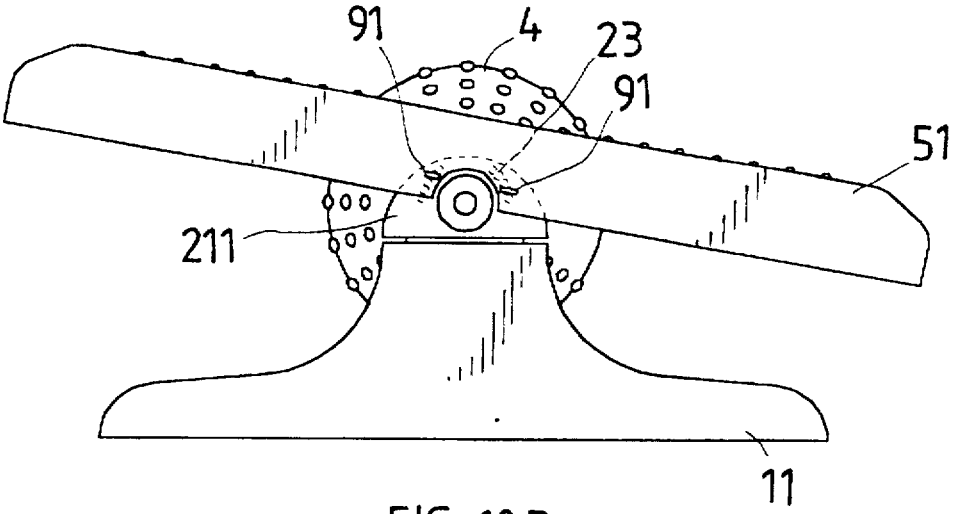

Two pairs of locking holes 514 and 524 are provided at outer side walls of the pedals 51 and 52, respectively, with two locking holes of each pair located at two sides of the shaft 3. A plurality of locating holes 23 are provided on outer side surfaces of the upper shaft holder portions 211 and 221 of the adjusting supports 21 and 22 along an arcuated top periphery thereof. Two pairs of locking pins 91 and 92 can be used to insert into the locking holes 514 and 524 on the pedals 51, 52 and two of the locating holes 23 on the adjusting supports 21, 22, as shown in FIG. 9, so as to locate the pedals 51 and 52 in a certain fixed position. In FIG. 10A, locking pins 91 are inserted into the locking holes 514 and two of the locating holes 23, such that the pedal 51 is unmovably inclined at an angle of large degree. And, in FIG. 10B, locking pins 91 are inserted into the locking holes 514 and another two locating holes 23, such that the pedal 51 is unmovably inclined at an angle of small degree.

To use the pedal structure of the present invention, a user may adjust the height of the adjusting supports 21 and 22 relative to the bases 11 and 12 according to his or her leg length and the height of chair in which the user sits. Then, the user may select to lock or not to lock the two pedals 51 and 52 together by the pedal latches 81 and 82 according to his or her own preference. Finally, the user may select to use the locking pins 91 and 92 to locate the pedals in place or not to use the locking pins and allow the pedals to freely swing about the shaft 3. After the whole pedal structure is assembled and adjusted to a desired position, it can be positioned under a desk for resting two feet thereon.

If the user wants to move two feet at the same time and in the same direction, he or she needs only to lock the pedals 51 and 52 together by pedal latches 81 and 82 and remove the locking pins 91 and 92 from the locating holes 23 of the shaft holder portions and the locking holes 514, 524 on the pedals 51, 52.

If the user wants to move two feet in different directions, he or she needs only to release the pedal latches 82 and 81 from the catcher pairs 512, 513 and 522, 523 and thereby unlocks the pedals 51 and 52 for them to move independently.

Or, if the user does not want to move his or her two feet, he or she needs only to insert the locking pins 91 and 92 into the locking holes 514 and 524 on the pedals 51, 52 as well as the locating holes 23 on the shaft holder portions 211 and 221, allowing the pedals 51 and 52 to be fixed in place for resting two feet.

When the user is tired from working, he or she may rest one or two feet on the massage ball 4 to contact with the protuberances 41 while rotates the massage ball 4 with the foot or feet. Whereby, the user may get his or her sole or soles massaged and recover from tireness more quickly.

Figure 11:
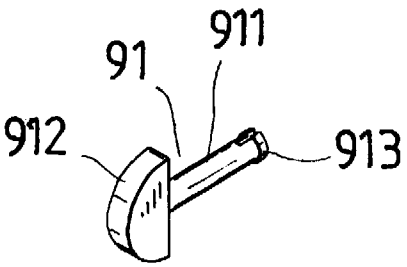
FIG. 11 is an enlarged perspective of the locking pin of the present invention.

As shown in FIG. 11, the locking pin 91 each includes a latch portion 911, a head portion 912, and an expanded tail portion 913 and can be conveniently inserted into the locking and locating holes. The locking pins 92 have the same structure as that of the locking pins 91 and are therefore not repeatedly described herein. Two storage holes 93 are provided on an outer side wall of each base 11 or 12 near a bottom edge thereof. When the locking pins 91 or 92 are not in use, they can be stored in the storage holes 93 without being carelessly lost.

A separate through hole 94 is formed on the outer side wall of each base 11, 12, too, for a fastening means 95 to extend through and tighten the base against the adjusting support, as shown in FIG. 9, lest the adjusting support should become loose from the base when the pedal structure is in use.

Figure 12A:
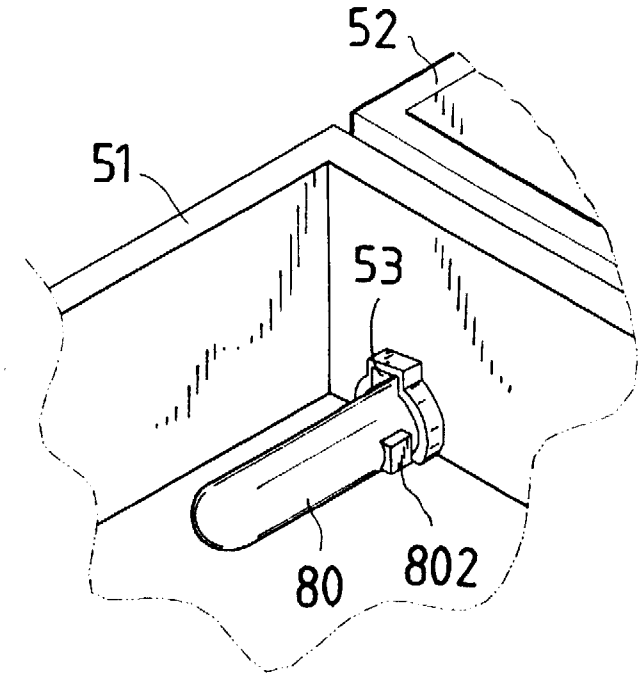
FIG. 12A is a fragmentary perspective showing the pedals being locked together by the pedal latch of FIG. 12.
Figure 12:
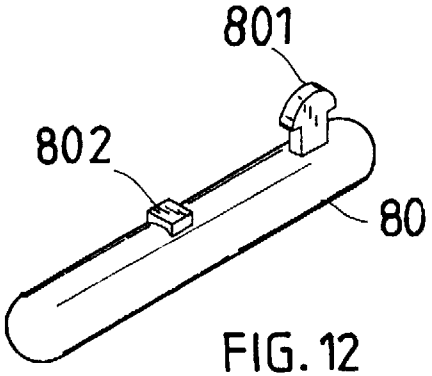
FIG. 12 is a second embodiment of the pedal latch which is provided with a locking block.

FIG. 12 illustrates a second embodiment of the pedal latch 80. The pedal latch 80 also includes a tail retaining block 801 but is different from the pedals 81 and 82 in an additional locking block 802. As shown in FIG. 12A, key holes 53 are formed on the adjacent side walls of the pedals 51 and 52 for the pedal latches 80 to extend through. After the locking blocks 802 have passed through the key holes 53, the pedal latches 80 are turned with the retaining blocks 801 retained by the corresponding catchers on the pedals and the locking blocks 802 stopped by inward projected walls surrounding a portion of the key holes 53 having a smaller diameter. Whereby, the two pedals 51 and 52 are locked together without the risk of separating from one another caused by any sliding of the pedal latchers 80 in the key holes 53.

Figure 13:
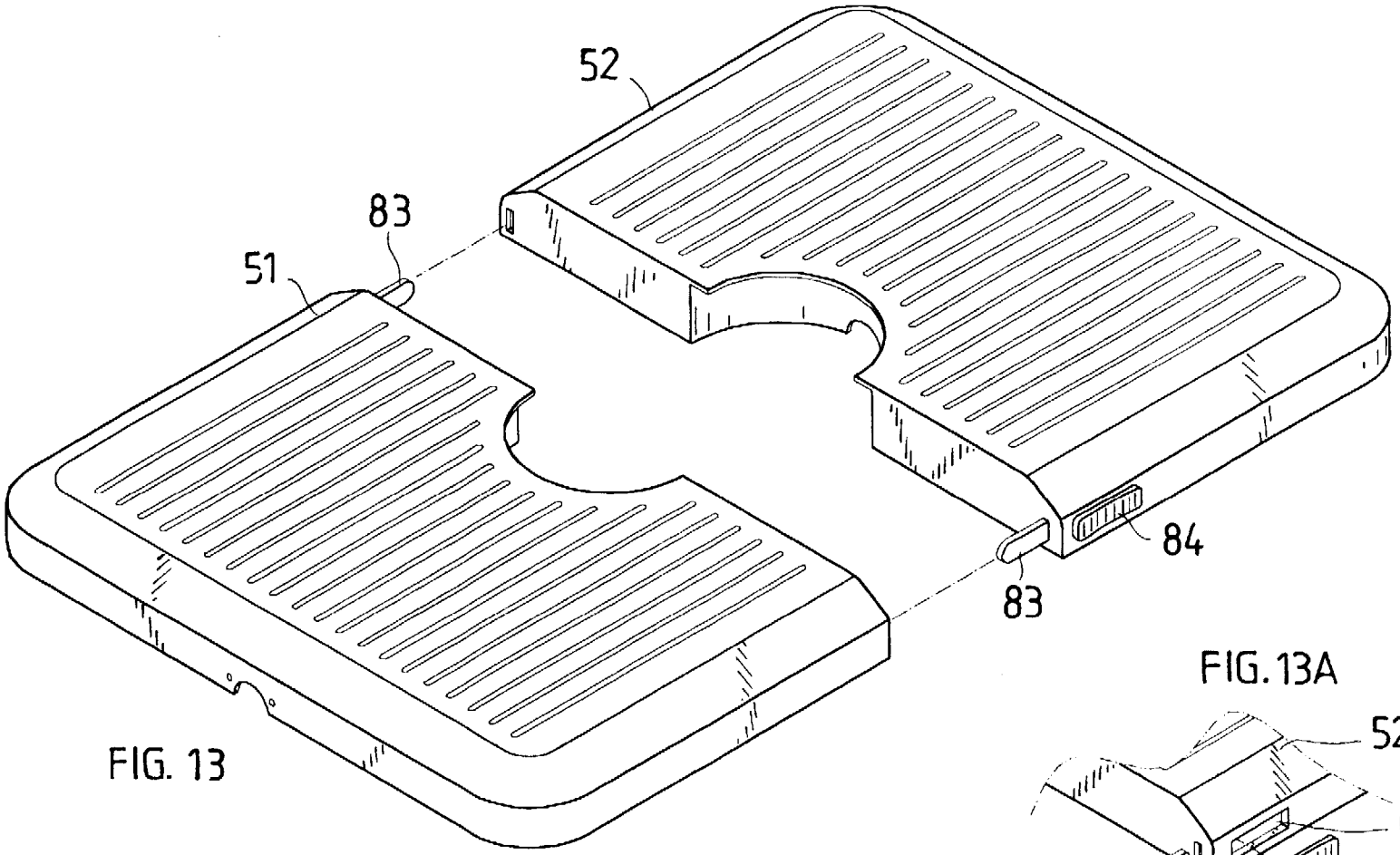
FIG. 13 shows a third embodiment of the pedal latch of the present invention.
Figure 13A:
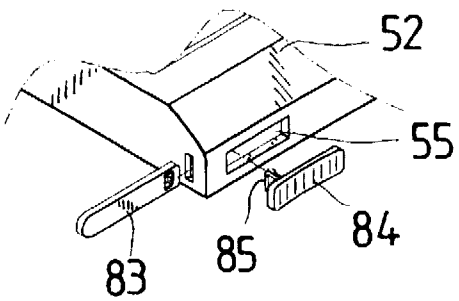
FIG. 13A is an exploded perspective of the pedal latch shown in FIG. 13.

FIGS. 13 and 13A illustrates still another embodiment of the pedal latches 83. The pedal latches 83 are provided inside a front and a rear side wall of the pedals 51 and 52, respectively, and are operated via sliding blocks 84 mounted outside the front and the rear side wall of the pedals 51 and 52. The sliding block 84 each contacts with the pedal latch 83 via a connecting part 85 projected from an inner surface of the sliding block 84 and extending through a sliding slot 55 formed on the front or the rear side wall of the pedal 51 or 52, bringing the pedal latch 83 to move along with the sliding block 84 in the same direction. By pushing the sliding block 84 forward, the pedal latch 83 can be extended through the adjacent side walls of the pedals 51 and 52 and lock the pedals together. And, by pushing the sliding block 84 backward, the pedal latch 83 are backed to unlock the two pedals 51 and 52.

Figure 14A:
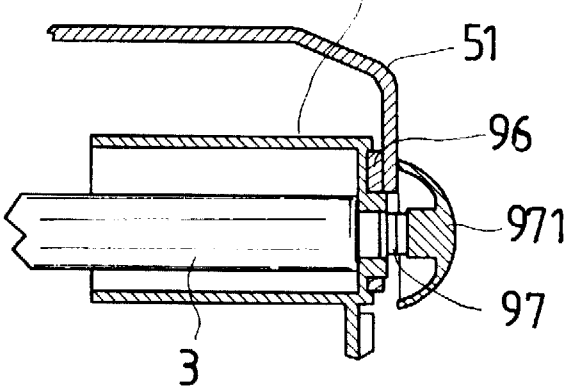
FIG. 14A is a fragmentary sectional view showing the pedal is tightly frictionally contacted with a frictional ring mounted on the adjusting support when a fixing bolt is tightened through the fictional ring.
Figure 14B:
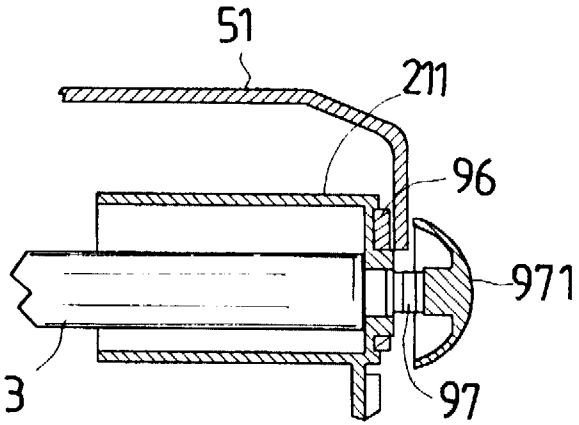
FIG. 14B is a sectional view similar to FIG. 14A but with the fixing bolt loosened to allow the pedal to loosely contact with the frictional ring on the adjusting support.
Figure 14:
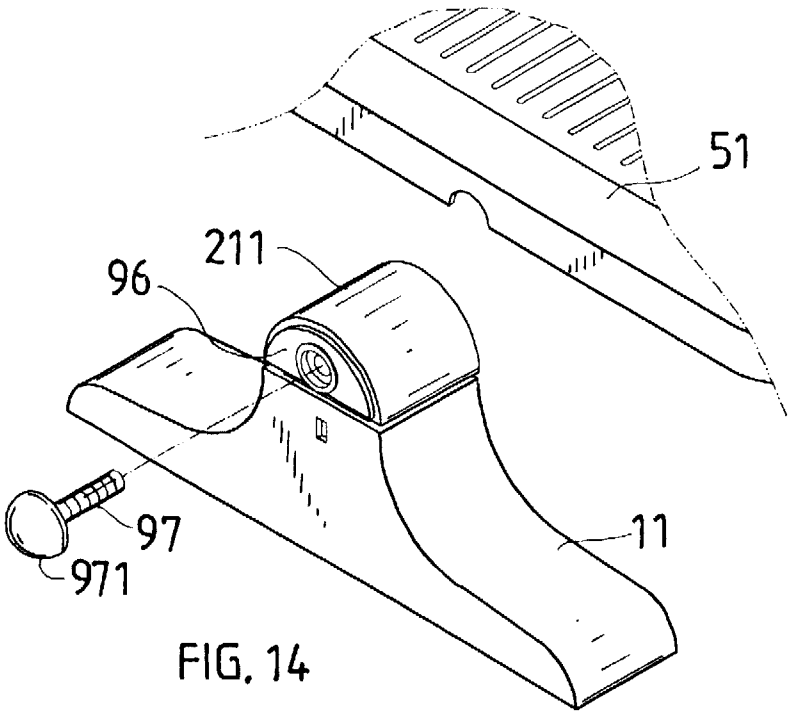
FIG. 14 illustrates another way to lock the pedals to the adjusting supports in place.

FIG. 14 illustrates another control mechanism to lock the pedals 51 and 52 to the shaft holder portions 211 and 221. This control mechanism includes a frictional ring 96 and a fixing bolt 97 provided to each shaft holder portion 211 or 221. The frictional ring 96 is made of rubber material to produce sufficient friction resistance. The fixing bolt 97 is used to screw into the shaft holder portion 211, 221 via the frictional ring 96 and has an expanded head portion 971. As shown in FIG. 14A, when the fixing bolt 97 is tightly screwed toward the shaft holder portion 211 via the frictional ring 96, the expanded head portion 971 of the fixing bolt 97 shall press against the outer side wall of the pedal 51 and causes the same to tightly contact with the frictional ring 96 without the possibility to swing about the shaft 3. In FIG. 14B, the fixing bolt 97 is loosened from the shaft holder portion 211 and the expanded head portion 971 thereof no longer presses against the pedal 51, allowing the pedal 51 to swing about the shaft 3. This control mechanism allows the pedals 51 and 52 to be more easily fixed to or loosened from the adjusting supports. It is understood that the same control mechanism is provided to the shaft holder portion 221 at the other side.

What is claimed is:

1. A pedal structure comprising:

a pair of bases each having a vertically extended long recess formed at an inner side and said long recess each being provided at two inner side walls with horizontally and parallelly extended teeth;

a pair of adjusting supports each including an upper shaft holder portion and a lower coupling rod portion, said lower coupling rod portion each having two outer side walls provided with horizontally and parallelly extended teeth to fitly engage with said teeth of said long recess, allowing said adjusting supports to be received in said long recesses at different heights;

a shaft being disposed between said two adjusting supports with two ends of said shaft received in said two shaft holder portions; and a pair of pedals being assembled to said shaft by means of braces wrapping said shaft and secured to said pedals by means of screws, such that said pedals are allowed to rotate about said shaft, and at least two braces being used to assemble each said pedal to said shaft;

whereby said pedal structure may be adjusted to have different heights by engaging said toothed lower coupling rod portions of said adjusting supports into said toothed long recesses of said bases at different heights.

2. A pedal structure as claimed in claim 1, wherein said shaft being provided at a central point with a massage ball, such that said massage ball is allowed to freely rotate about said shaft; and said massage ball being provided on an outer surface with a plurality of protuberances which massage a user's sole or soles when the user forces said massage ball to rotate by resting foot or feet on said massage ball.

3. A pedal structure as claimed in claim 2, wherein said two pedals being provided on top surfaces with a plurality of transverse fine lines.

4. A pedal structure as claimed in claim 1, wherein said two pedals are provided on bottom surfaces near their adjacent side walls each with a pedal latch separately located at two sides of said shaft, said pedal latch each including a tail retaining block which can be retained in place by catchers correspondingly provided on said bottom surface of said pedal opposite to said pedal latch, whereby said pedal latches can be extended through said adjacent side walls of said two pedals to lock said two pedals together for them to move at the same time, or be backed from said adjacent side walls of said two pedals to allow said two pedals to swing about said shaft independently.

5. A pedal structure as claimed in claim 4, wherein said pedal latch each further has a raised locking block, and wherein said adjacent side walls of said two pedals are formed with key holes for said pedal latch having a locking block to pass through, whereby said raised locking block is stopped by an inward projected wall surrounding a portion of each said key hole having a smaller diameter after said pedal latch extends through said adjacent side walls of said pedals and is retained in place by said corresponding catchers.

6. A pedal structure as claimed in claim 1, wherein said two pedals are provided at their outer side wall each with a pair of locking holes to locate at two sides of said shaft, and wherein said upper shaft holder portions of said adjusting supports are provided at their outer surface along an arcuated top periphery thereof with a plurality of locating holes, whereby locking pins can be selectively inserted into said two pairs of locking holes and said locating holes to lock said pedals in a desired inclined position without the possibility to be rotated about said shaft.

7. A pedal structure as claimed in claim 1, wherein said base each is provided at an outer side wall with a through hole for a fastening means to extend through and tighten said base against said adjusting support, lest said adjusting support should become loose and separated from said base when said pedal structure is in use.

8. A pedal structure as claimed in claim 1, wherein said two pedals are separately provided behind a front and a rear side wall with a pedal latch operated via a sliding block provided on an outer surface of said front and said rear side wall of said pedals, said sliding block contacting with said pedal latch via a connecting part projected from an inner surface of said sliding block and extending through a sliding slot formed on said front and said rear side wall of said pedals, bringing said pedal latch to move along with said sliding block when said sliding block is pushed.

9. A pedal structure as claimed in claim 1, wherein a frictional ring capable of producing sufficient friction and resistance is mounted on an outer surface of each said shaft holder portion for a fixing bolt having an expanded head portion to releasably screw thereinto, whereby when said fixing bolt is tightly screwed into said frictional ring, said expanded head portion of said fixing bolt firmly presses said outer side wall of said pedal against said frictional ring, causing said pedal to be fixed in place without being moved.

* * * * *